United States Patent [19]

Furia

[11] 4,011,738

[45] Mar. 15, 1977

[54] MANUFACTURING OF PANTYHOSE OR TIGHTS USING A CIRCULAR KNITTING MACHINE

[75] Inventor: Edoardo Furia, Florence, Italy

[73] Assignee: Nova-Tec Establishment, Liechtenstein

[22] Filed: Mar. 27, 1974

[21] Appl. No.: 455,387

Related U.S. Application Data

[63] Continuation-in-part of Ser. No. 171,169, Aug. 12, 1971, abandoned.

[52] U.S. Cl. ..... 66/14; 66/177; 66/22; 66/104

[51] Int. Cl.[2] ..... D04B 9/10; A41B 9/14

[58] Field of Search ..... 66/14, 104, 17, 22, 66/177, 19

[56] References Cited

UNITED STATES PATENTS

| | | | |
|---|---|---|---|
| 360,735 | 4/1887 | Schroeder et al. | 66/8 |
| 2,101,494 | 12/1937 | Deans et al. | 66/14 |
| 2,286,771 | 6/1942 | Thurston | 66/14 |
| 2,365,801 | 12/1944 | Bristow | 66/14 |
| 2,408,807 | 10/1946 | Norman | 66/17 |
| 2,736,177 | 2/1956 | Bristow | 66/14 |
| 2,988,905 | 6/1961 | Mishcon | 66/19 |
| 3,009,339 | 11/1961 | Fouts | 66/17 |
| 3,018,646 | 1/1962 | Wainwright | 66/14 UX |
| 3,386,267 | 6/1968 | Widdowson et al. | 66/14 |
| 3,605,444 | 9/1971 | Lonati | 66/14 |
| 3,673,821 | 7/1972 | Johnson | 66/177 |

FOREIGN PATENTS OR APPLICATIONS

| | | | |
|---|---|---|---|
| 1,138,883 | 10/1962 | Germany | 66/8 |
| 2,201,766 | 8/1972 | Germany | 66/177 |
| 296,061 | 11/1929 | United Kingdom | 66/17 |
| 535,946 | 4/1941 | United Kingdom | 66/14 |
| 301,350 | 11/1928 | United Kingdom | 66/14 |

*Primary Examiner*—Mervin Stein
*Assistant Examiner*—Andrew M. Falik
*Attorney, Agent, or Firm*—McGlew and Tuttle

[57] ABSTRACT

The pant or body portion of a pair of tights or panty hose is produced on a dual-cylinder knitting machine using oscillatory motion of the two cylinders. Subsequently the leg portions of the tights are produced using continuous motion of the two cylinders, one leg portion being formed within the other leg portion.

8 Claims, 31 Drawing Figures

Fig. 1
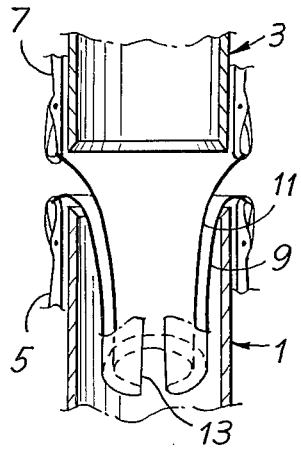
Fig. 4
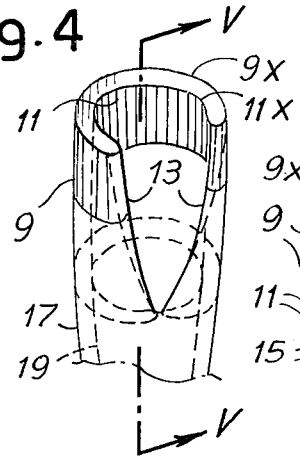
Fig. 5
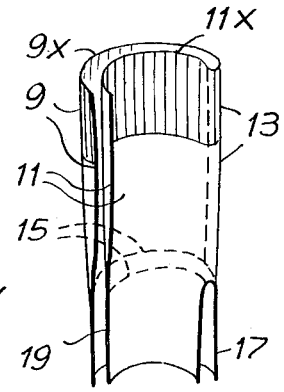
Fig. 3
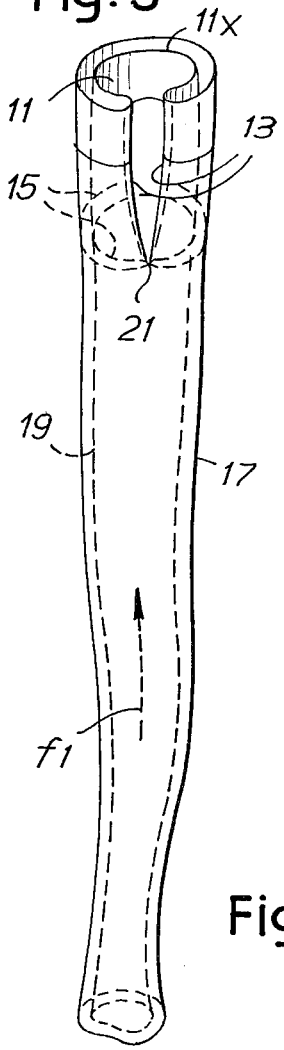
Fig. 2
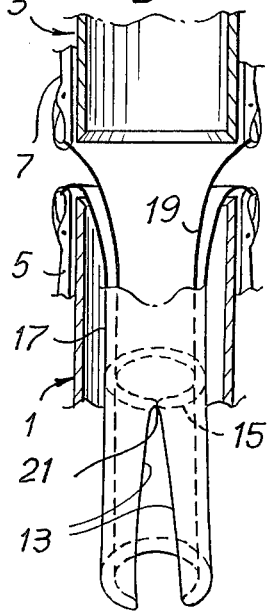
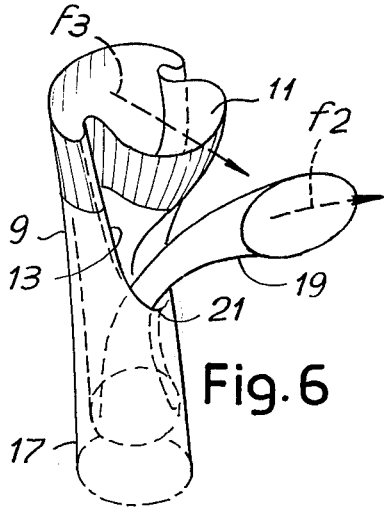
Fig. 6
Fig. 7
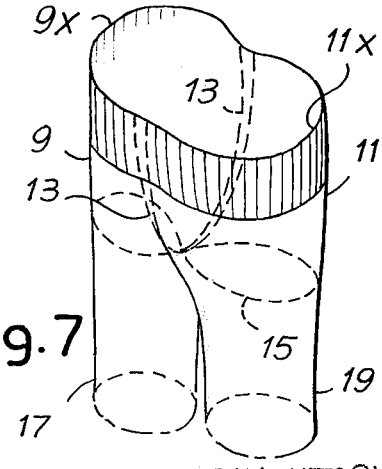
INVENTOR:
EDOARDO FURIA
BY: John A. McKew
ATTORNEY

INVENTOR
EDOARDO FURIA

BY: John J. McGlew
ATTORNEY

MANUFACTURING OF PANTYHOSE OR TIGHTS USING A CIRCULAR KNITTING MACHINE

CROSS REFERENCE TO RELATED APPLICATION

This application is a continuation-in-part of application Ser. No. 171,169, filed Aug. 12, 1971, for "The Manufacture of Collants or Tights Using a Circular Knitting Machine", now abandoned.

FIELD OF THE INVENTION

The present invention relates to the manufacture of pantyhose or tights, or like articles.

BACKGROUND OF THE INVENTION

In the prior art, pantyhose or tights are produced by knitting two separated tubular portions which are then longitudinally cut and manually sewn together. Pantyhose and tights produced in accordance with the prior art are relatively expensive to produce as well as being subject to "ladder" and having other defects.

SUMMARY OF THE INVENTION

According to the invention, there is provided a method for forming a pantyhose having two tubular leg portions and a pant portion using a circular knitting machine having two groups of needles, wherein the pant portion is formed by alternating motion of the two groups of needles to produce courses of stitches extending over substantially 360°, a yarn being passed from one group of needles to the other group of needles at each reversal so as to form inner and outer longitudinally split tubular layers of fabric which are joined together along their longitudinal edge portions, and wherein the leg portions are formed by continuous motion of the needles with an independent feed to each group of needles so as to produce one leg portion within the other leg portion, the said other leg portion having a plain stitch and the said one leg portion having a purl stitch.

The leg portions can be formed prior to the pant portion. Preferably, however, the pant portion is produced first, by alternating motion of the groups of needles, and then the leg portions are produced by continuous motion of the groups of needles. The two leg portions can be finished by a resilient cuff welt and closed at their ends.

Preferably, the circular knitting machine for producing the pantyhose comprises two grooved beds for the needles, the beds being coaxial and having respective groups of needles arranged to operate independently without interfering with the needles of the other group, means selectively operable to rotate the beds synchronously through about 360°, and to continuously rotate the beds, means for feeding a common yarn to the two groups of needles during the subsequent stages of the oscillatory motion, at each reversal, and to feed two yarns independently of the two groups of needles during the continuous rotational motion, and means for actuating the needles of the two groups to form stitches alternately during the oscillatory motion, and for actuating the needles of the two groups to form the stitches simultaneously but without a reciprocal or mutual interference, during the continuous motion.

The two groups of needles are preferably formed by two coaxial grooved cylinders, each including conventional latch needles. However, the two groups of needles need not be cylindrical. For example one group can be conical, or can have radial needles. In each arrangement, the needles of one of the groups are offset with respect to the needles of the other group.

Advantageously — especially when the two groups of needles are cylindrical — each of the needles of at least one group is flanked by two sinkers, whereby two sinkers are located between two adjacent needles of that group.

BRIEF DESCRIPTION OF THE DRAWINGS

The invention will now be described, by way of example only, with reference to the accompanying diagrammatic drawings, in which:

FIGS. 1 and 2 illustrate the manner in which tights are produced on a dual-cylinder circular knitting machine;

FIG. 3 is a perspective view of the finished tights after removal from the machine;

FIG. 4 is a perspective view, to an enlarged scale, of the upper end portion of the tights shown in FIG. 3;

FIG. 5 is a section taken on line V—V in FIG. 4;

FIG. 6 is a perspective view illustrating the manner in which the tights shown in FIG. 3 are arranged in a configuration suitable for use;

FIG. 7 is a perspective view of the upper end portion of the tights after being arranged as shown in FIG. 6;

DESCRIPTION OF THE PREFERRED EMBODIMENTS

Figure 8:
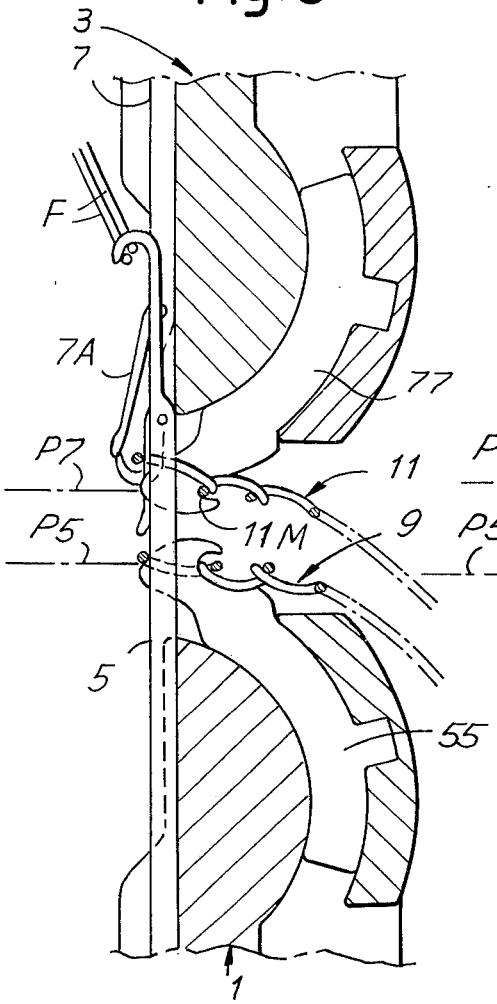
FIGS. 8 and 9 are fragmentary longitudinal sections through the needle cylinder of the knitting machine.
Figure 9:
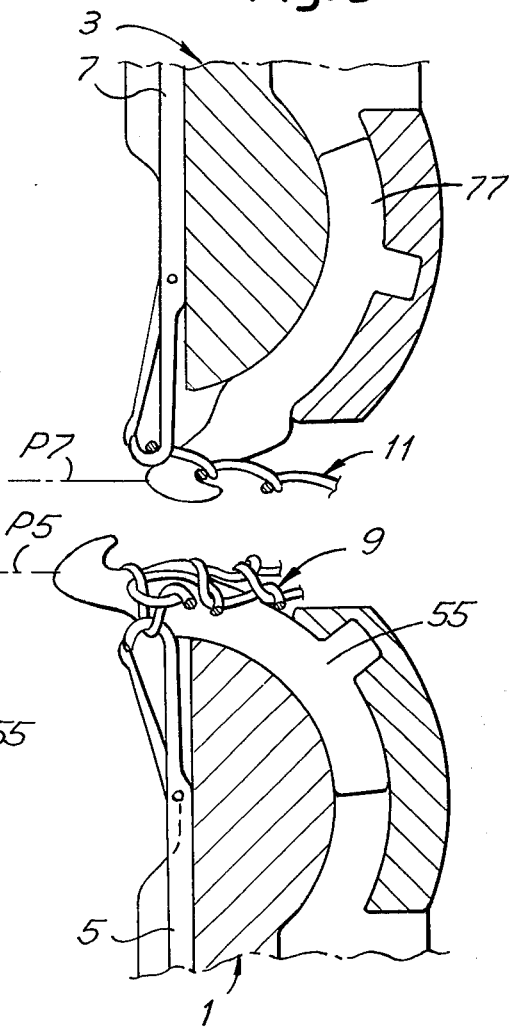

With reference to FIGS. 1 to 7, and more particularly to FIGS. 1 and 2, a circular knitting machine comprises two coaxial and oppositely directed needle cylinders 1 and 3. The cylinder 1 is conventionally arranged and has needles 5 provided with latches at their upper end portions, while the cylinder 3 is inverted with respect to the cylinder 1 and has needles 7 provided with hooks and latches at their lower end portions, the lower end portions of the needles 7 lying adjacent the upper end portions of the needles 5.

In the initial stages of forming the tights or pantyhose, the cylinders 1 and 3 are operated with a synchronous oscillatory motion, in such a manner that the cylinders, after each reversal, rotate through an angle of at least 360°, to alternately form, when one cylinder rotates in one direction and the other cylinder rotates in the opposite direction, subsequent courses of stitches. The courses extend for substantially 360° or a little less, and each time the needles of one cylinder are active and the needles of the other cylinder are inactive. Further, upon each reversal, the yarn or combined yarns fed to the machine are transferred from the cylinder which ceases to be active to the other cylinder which is active. In this manner, the needles of the two cylinders produce two layers of fabric, viz. an external layer 9 and an internal layer 11. Each layer of fabric is formed with courses of stitches which extend over almost 360°, the courses forming the layer 9 being continuous with the courses forming the layer 11 and vice versa, the two layers 9, 11 being, in effect, connected along two longitudinal edge portions 13. Adjacent the initial edges 9X, 11X of the layers 9, 11, respectively, a welt may be formed using a resilient yarn, to form a continuous resilient band, having a development such as that of the sections 9 and 11, corresponding substantially to twice the circumferential development of a cylinder.

The two layers 19, 11 thus formed extend for a length which corresponds to the length of the pant portion of the finished tights or pantyhose. The layers 9 and 11 are completed by a dual final course 15 of continuous stitches. Immediately after, two lengths of tubular fabric 17 and 19 are formed by continuous unidirectional rotation of the two cylinders 1 and 3. The tubular fabric 17 forms an extension of the layer 9 and the tubular fabric 19 forms an extension of the layer 11. The longitudinal edge portions 13 merge at a point 21 which is located on the final course 15. FIG. 12C illustrates a stitch in the area of the point 21, with sinkers being omitted, for clarity, at the point $\alpha$.

Upon the change from oscillatory motion to continuous rotational motion of the needle cylinders, the yarn feed is also changed. The two layers 9, 11 are formed by a double yarn, fed by two yarn-guides moved together to cyclically feed the needles of each cylinder. In correspondence of the course 15 and of the point 21, the two yarn-guides are separated and are fixedly positioned so that each guide feeds the needles of a respective cylinder, independently of the feed to the other cylinder. Thus the layers 9 and 11 are formed with a yarn having a higher count than the yarn used to form the lengths of tubular fabric 17 and 19, which constitute the leg portions of the finished tights. Alternatively, the yarn can be replaced after the layers 9 and 11 have been formed, and two thinner yarns can be used to form two lengths of tubular fabric 17 and 19. In a further arrangement the yarn, which has been used to form the layers 9 and 11, is used for form one of the lengths of tubular fabric 17 or 19, an additional independent yarn feed being provided for the other length of tubular fabric 17, or 19. Formation of the two lengths of tubular fabric 17 and 19 continues until they reach the desired length, the two lengths extending axially through one of the cylinders (the cylinder 1 as shown in the drawing). When the two lengths of tubular fabric 17 and 19 reach the desired length, the yarn feeds are interrupted and the two lengths of tubular fabric 17 and 19 are detached from the respective needles. The lengths of tubular fabric 17 and 19 can also be formed using multiple feeds, and/or with appropriate patterns or with special stitches of per se known type.

As shown in FIG. 3 the tubular fabric 19 is disposed within the tubular fabric 17. If, in the finished tights or pantyhose, the outer surfaces of the leg portion formed by the tubular fabric 17 corresponds to the outer surface of the tubular fabric 17 as viewed in FIG. 3, the outer surface of the leg portion formed by the tubular fabric 19 corresponds to the innermost surface of the tubular fabric 19 as viewed in FIG. 3. In order to arrange the leg portions in a configuration suitable for use, the end portion of the tubular fabric 19 is turned inwardly within itself and is withdrawn in the direction of the arrow f1 in FIG. 3 and is then withdrawn in the direction of the arrow f2 of FIG. 6 from the opening defined by the edge portions 13. The final configuration is shown in FIG. 7, the layer 11 having been drawn in the direction of the arrow f3 of FIG. 6. The band of resilient fabric adjacent to the edges 9X, 11X forms a waist band, the portions 13 form a so-called "trousers middle cut" profile and the layers 9 and 11 form the pants portion. The lower end of the leg portions can then be closed to form the foot portions of the tights if such closure is not effected on the knitting machine. In the case where such closures are not required, the lower end portions of the two leg portions can be finished with a cuff or with a resilient fabric.

The dual-cylinder knitting machine briefly described with reference to FIGS. 1 and 2 will now be described in greater detail with reference to FIGS. 8 and 11.

Figure 10:
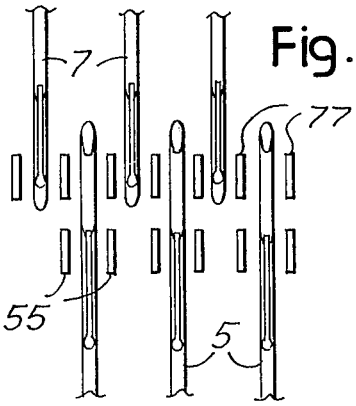
FIG. 10 is a view looking in a radial direction and illustrating the arrangement of the needles and sinkers of the knitting machine.

In the machine, the stitch forming planes P5 and P7 of the respective groups of needles 5 and 7 of the cylinders 1 and 3, forming respective coaxial grooved needle beds, should be as close together as is possible in order to restrict the width of the longitudinal transition zones (viz. the edge portions 13) between the layers 9 and 11 formed by oscillatory motion of the cylinders. Thus the working strokes of the needles 5 must extend between the inactive needles 7 and vice versa. In FIG. 8 there is shown an active needle 5, fed by a double yarn F, while a needle 7 is shown in a rest position in which its latch 7A is closed. Arcuate sinkers 55 and 77, which are similar to those provided for one cylinder of conventional dual-cylinder machines, are arranged in both cylinders, and the needles are similar to those used in conventional single-cylinder machines. Further, as shown in FIGS. 10 and 11, the needles 5 and 7 of the respective groups are offset in such a manner that each needle 5 in the yarn take-up position is interposed between two adjacent needles 7 and vice versa, two sinkers 55 being positioned between pairs of adjacent needles 5 and two sinkers 77 being positioned between pairs of adjacent needles 7. Each needle 5 can be inserted between the adjacent sinkers 77 of each pair, and each needle 7 can be inserted between the adjacent sinkers 55 of each pair. This arrangement allows the free motion of the needles of one cylinder and the feed thereof, when the needles of the other cylinder are inactive. In particular, for instance considering FIGS. 10 and 11, the needles 5 (for forming a course of the layer 9) and which are shown as active can freely rise between the needles 7 when the sinkers 77 have moved radially inwardly, the stitches 11M last formed being shown schematically in FIG. 11. Further the needles 5 can freely pick up the yarn F which is fed tangential thereto.

The needles 5 and 7, which are similar to conventional latch needles, are arranged in such a manner that their shanks lie in a common imaginary cylindrical surface. In this manner the yarn take-up and the forming of the stitches are smoothly effected during the oscillatory motion of the cylinders. The yarn-guide for the yarn, or yarn-guides for the two double yarns F, cyclically move between two symmetrical positions with respect to the two stitch forming planes P5 and P7 respectively for the needles 5 and 7.

Figure 11:
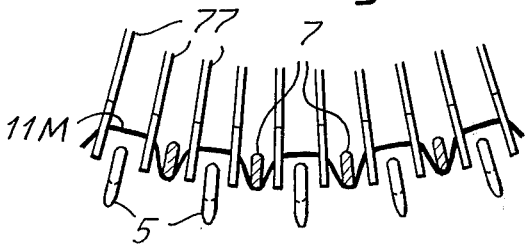
FIG. 11 is a fragmentary, transverse section illustrating the arrangement of the needles of the knitting machine.
Figure 15:
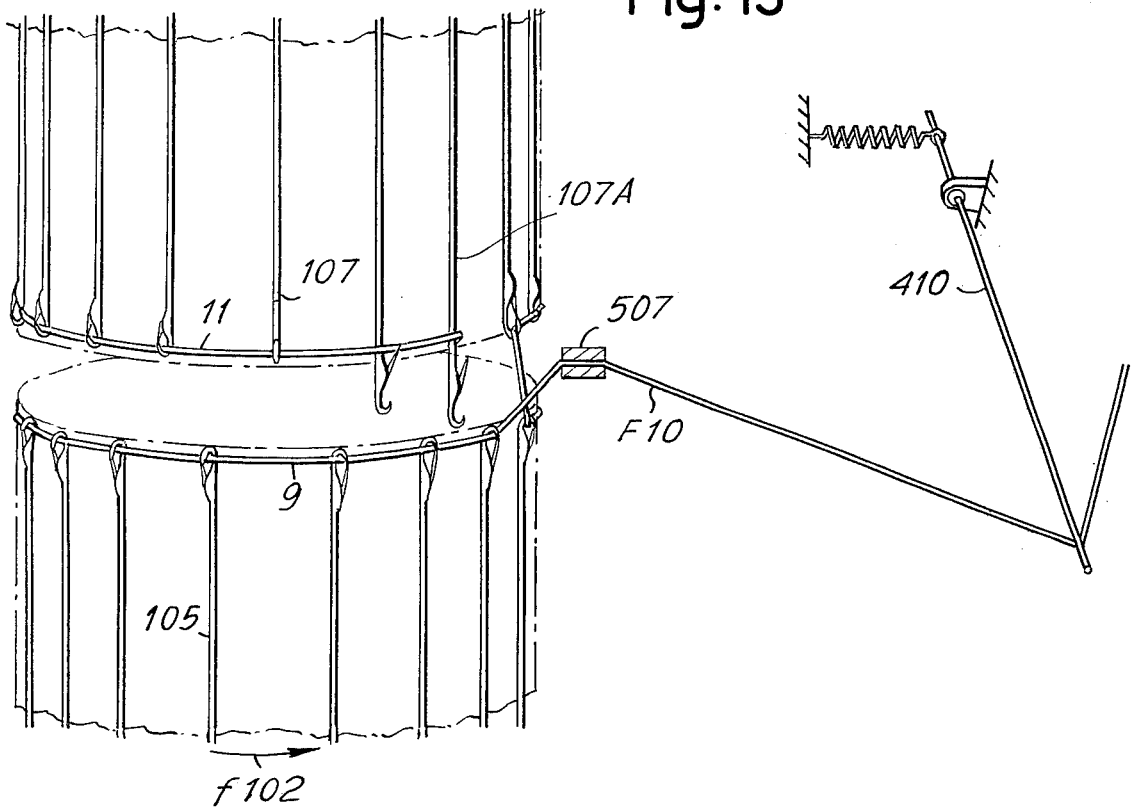
Figure 16:
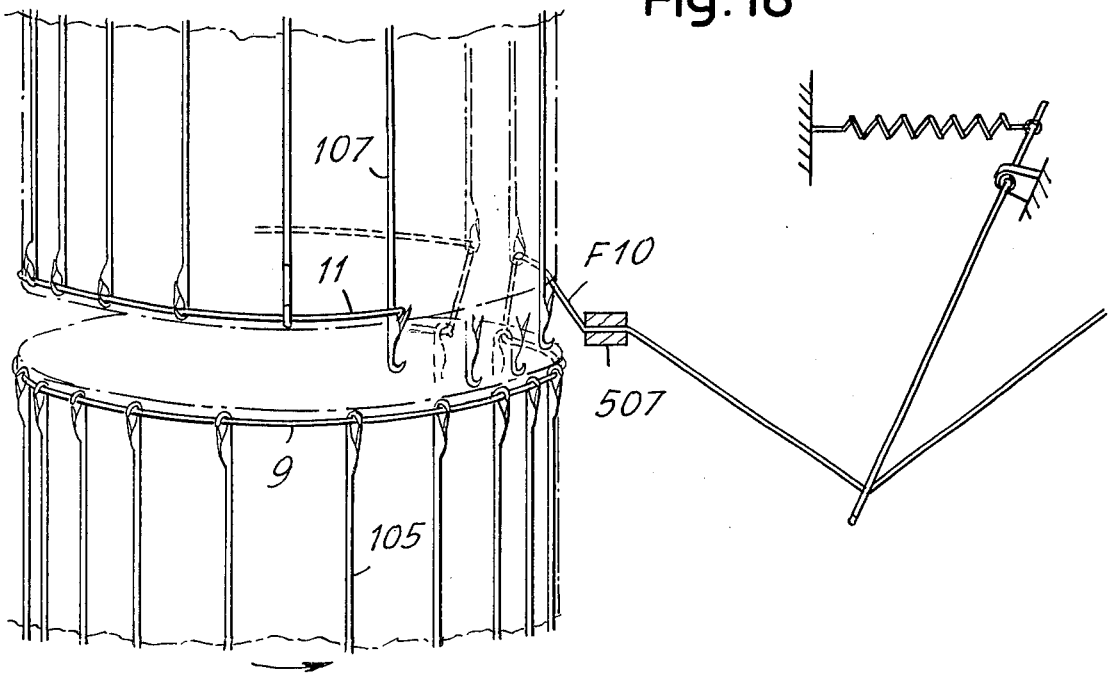

FIGS. 13 through 18 illustrate schematically, in perspective view, needles 105 of the lower cylinder and needles 107 of the upper cylinder, the needles being shown, for the purpose of clarity in the figures, spaced much more widely apart than in actual practice, Needles 105 and 107 correspond, respectively, to the needles 5 and 7 of FIGS. 10 and 11. Each needle 105 and 107 has operatively associated therewith a respective jack 109 and 111, as can be seen in FIGS. 19 through 26 which illustrate the development of the needle and jack operating cams as viewed from the interior or inside of the lower and upper cylinders. At the right hand side of each of FIGS. 19 through 26, there are illustrated the lower needle 105, the two lower jacks 109, the upper needle 107 and the two upper jacks 111. Each pair of jacks provides four rows of butts, as indicated at A, B, C and D for the jacks 109 and at F, G, H and I for the jacks 111. The needles 105 and 107 have only a single butt. FIG. 17A illustrates a stage between the stages of FIGS. 17 and 18, with the yarns being shown without stitch loops. In FIG. 17A, $\alpha$ indicates the beginning of the added yarn.

In correspondence with the butts, there are indicated, in the cam developments, the zones where these butts are present and the instantaneous paths of the butts in the different stages or working steps. The several cams and their functions are described thereafter. With respect to any stage or working step, those cams in action are illustrated as shaded or dark, those cams in the insertion stage are indicated as sectioned, those cams in the extraction stage or step are illustrated as dotted within their outlines, and those cams out of work or retracted are illustrated only in outline.

The butts of the rows A, D and F, I are guide butts, and the butts of rows A and F cooperates with respective cams 501 and 601 that can be stationary. Cams 503 and 505 are rapidly actuated independently to be inserted during the transit of those zones missed by the butts B and C, respectively, and cams 603 and 605 are rapidly actuated when the butts in rows G and H, respectively, are absent.

Figure 19:
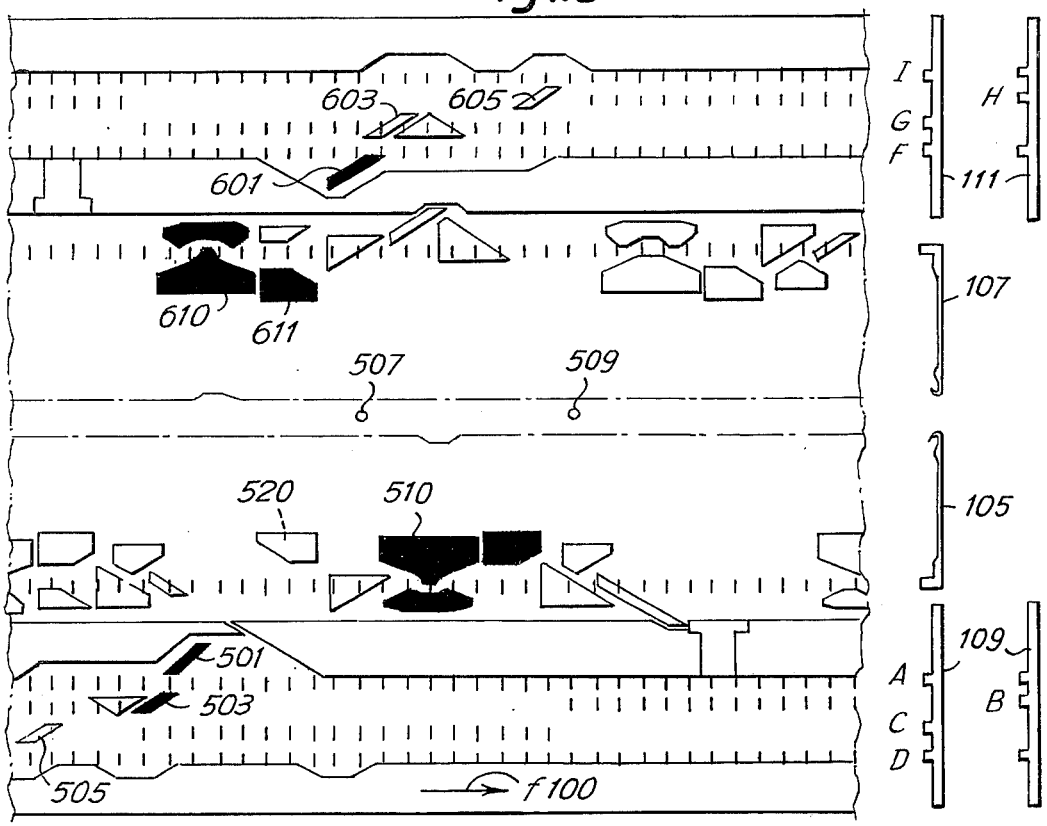
FIGS. 19 through 26 are linear development views, looking from the inside of the two needle cylinders, of the needle operating cams and the needle butts, with the upper and lower needles and the upper and lower needle jacks being illustrated at the right of each figure.

In the working step shown in FIG. 19, cams 501 and 503 are inserted and the yarn feed is operating with a yarn guide 507 located at about the mid position between the upper and lower cylinders. Cam 503 has been inserted in the free space, that is, the space where butts B are not present. The direction of the cylinder movement with respect to the cams is indicated by the arrow f100. Cams 603 and 605 are retracted, as well as cam 505.

Figure 20:
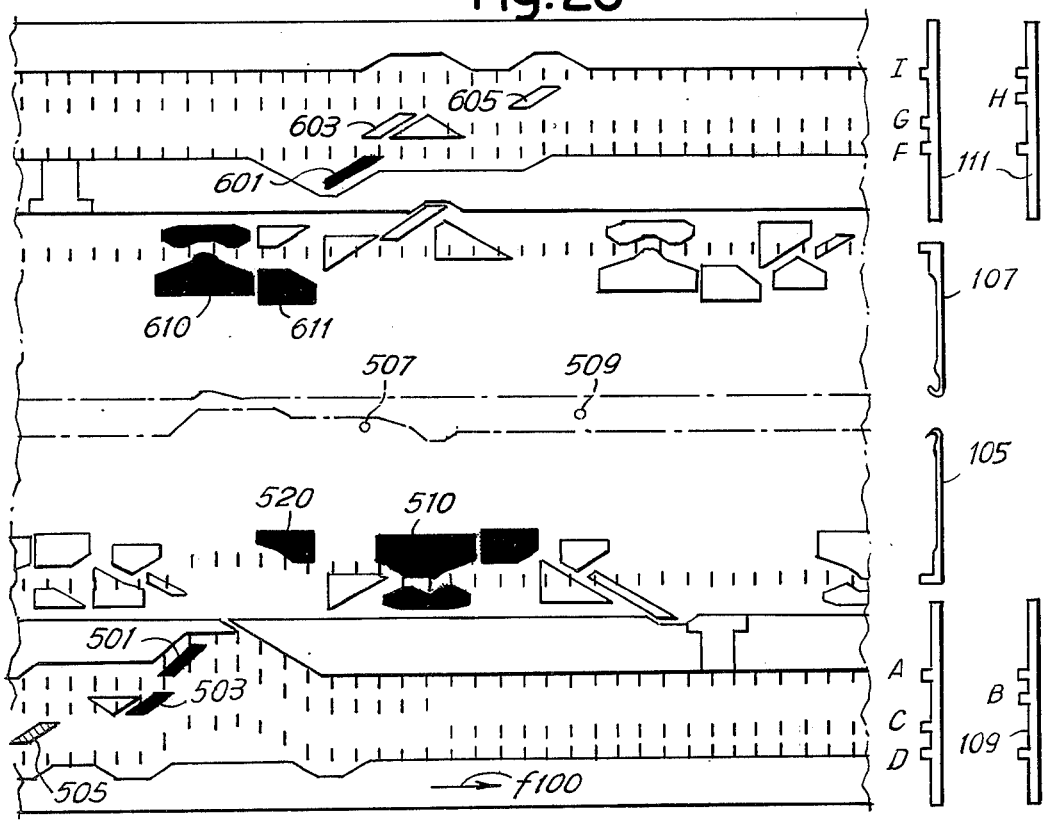
Figure 21:
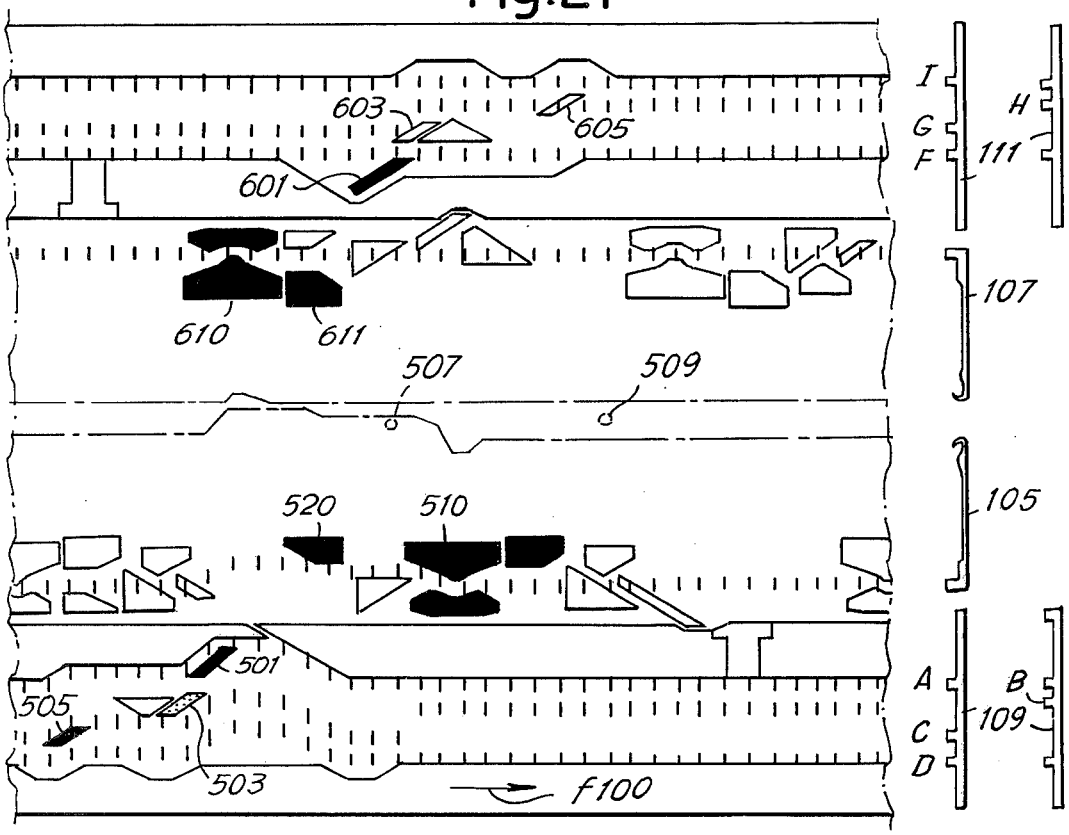

Butts B begin to be raised by cam 503, and butts A begin to be presented to cam 501. Jacks 109 thus raise needles 105, which take yarn from the feed position 507 and form the stitch with the cams 510, as shown in FIG. 20. In the working step shown in FIG. 20, cam 505 is about to be inserted into the space without butts C, and in such a manner that, when the butts C arrive at cam 505, they are raised, as shown in FIG, 21. Thus, jacks 109, with the aid of cam 501, keep on raising needles 105 to form the stitch with the yarn from the yarn guide in the position 107. During the working step shown in FIG. 21, cam 503 is retracted.

Figure 22:
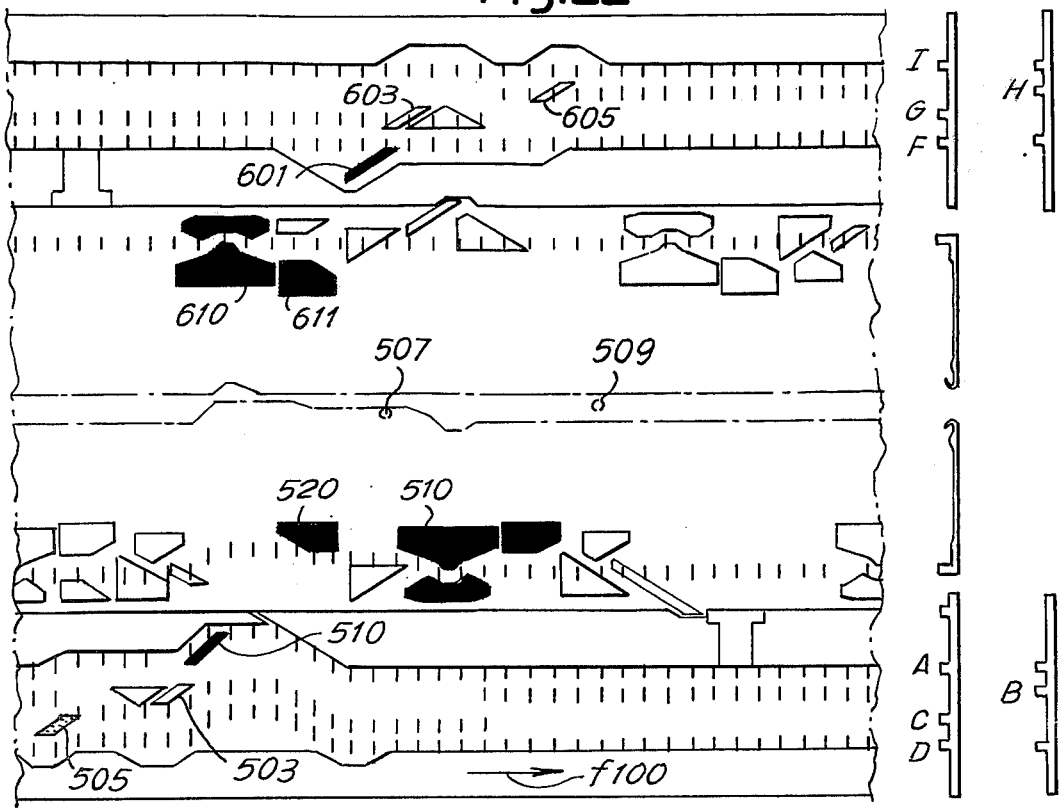

In the working step shown in FIG. 22, the control of the needlesis about to cease at the end of the 360° development of the cam layout. The cylinder continues rotating beyond 360° without further raising of the needles, owing to the fact that cam 503 is already withdrawn and cam 505 is about to stop acting on the group of butts C.

Figure 23:
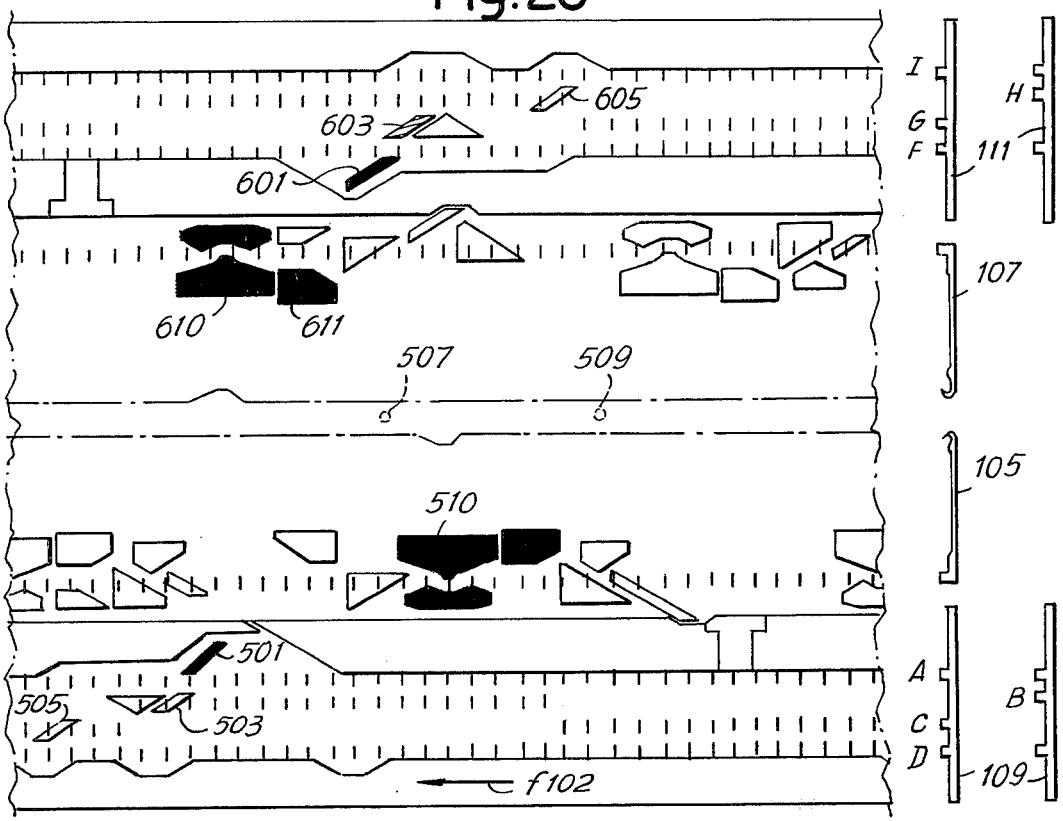

In the working step shown in FIG. 23, while the yarn-guide in position 507 remains active, the cylinder motion is reversed and takes the direction indicated by the arrow f102, this reversal taking place after the cylinder has travelled through an arc in excess of 360° in the direction of the arrow F101, to obtain a sure formation of stitches by the last needles in the step shown in FIG. 22. During the working steps shown in FIG. 22. During the working steps shown in FIGS. 22 and 23, cam 603 is moved into operation and cams 601 and 610 are already operating to form stitches by the needles of the upper cylinder.

Figure 24:
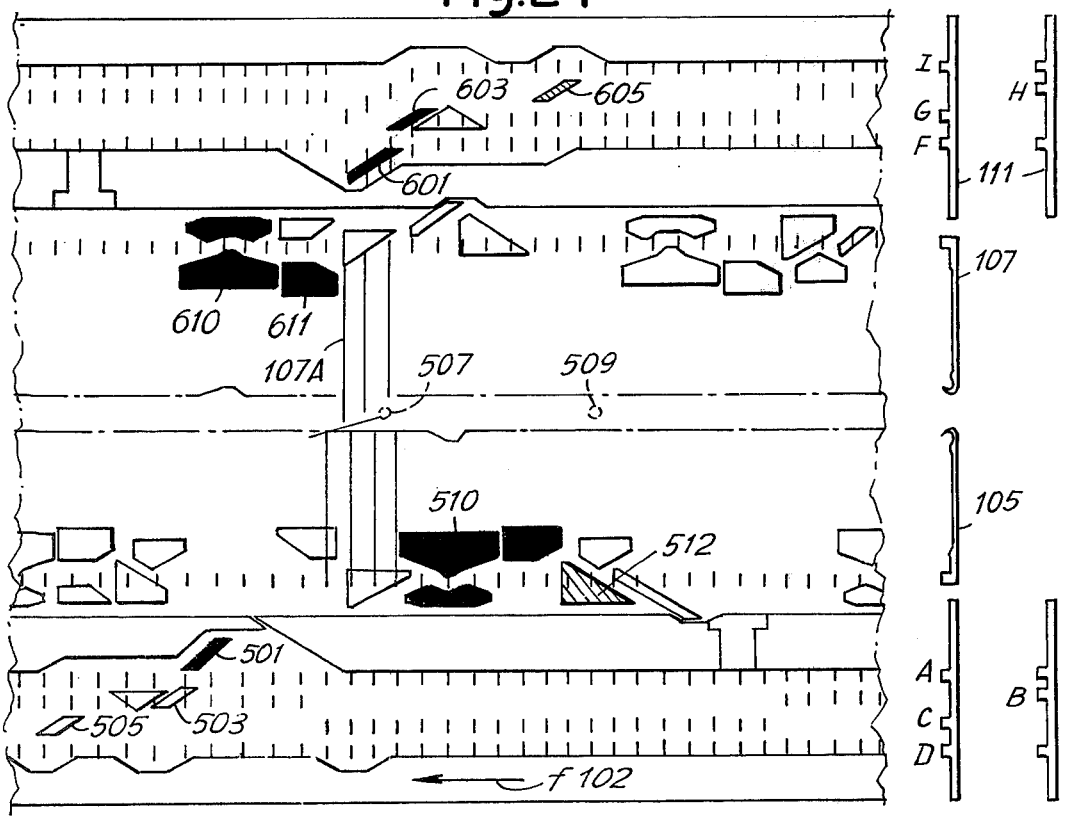

In the working step shown in FIG. 24, the first needles 107 are about to be moved downwardly by actuation of jacks 111, whose butts G are "raised", that is, actuated downwardly by cam 603 and the butts F of which are further "raised" by cam 601. In this step, cam 605 can be moved into operation at a moment when there are no butts H in front of it.

Figure 25:
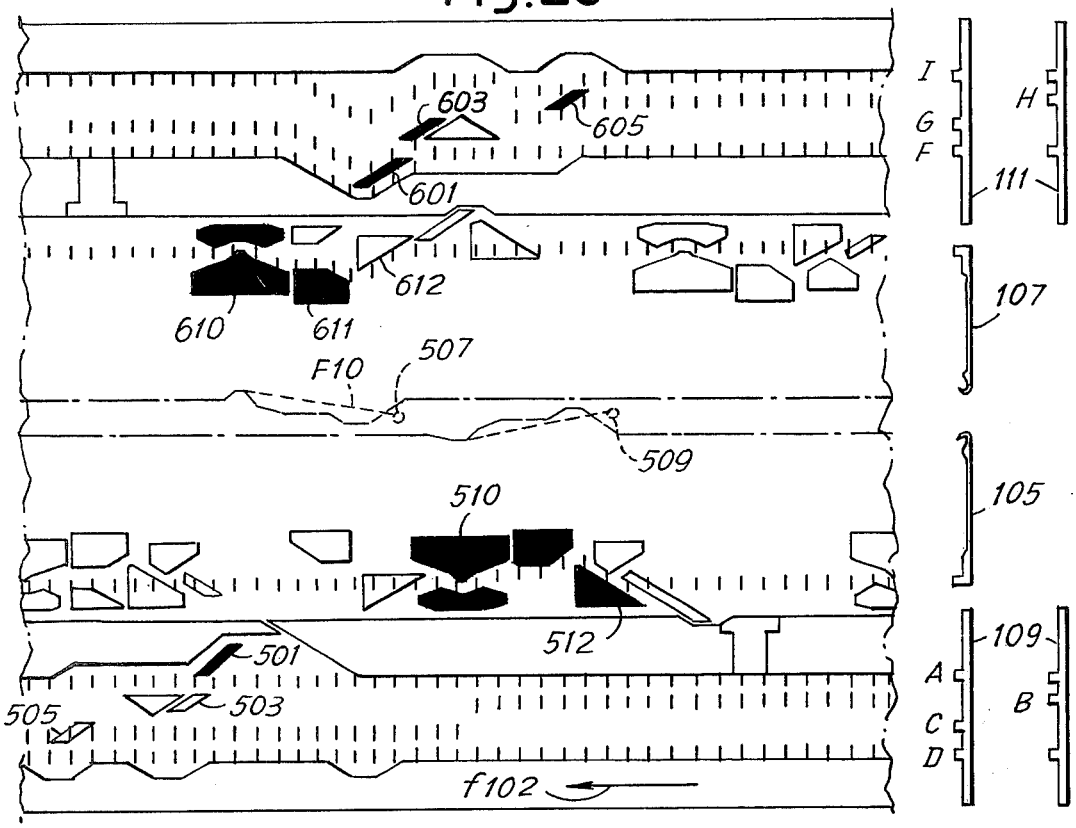

In the step of FIG. 25, the butts H begin to ride along cam 605, and the functioning of cam 603 is about to stop. The motion continues in the direction of arrow f102 until the end of the butts H that is, until the end of the useful 360° rotation plus a further arc to secure stitch formation with the yarn supplied by the yarn guide in position 507 and by the cam 610. The function is similar to that described at the end of the working step shown in FIG. 23. At this point, the motion can be again reversed to repeat the step of FIG. 19, with the yarn guide at 507 still being active.

Figure 12B:
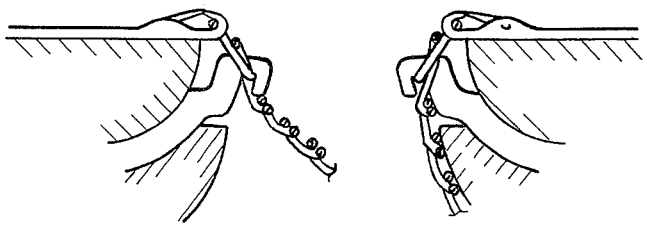
FIGS. 12A and 12B are, respectively, a partial front view and a sectional view of the two sets of needles and of the article formed thereby and partly removed, in a limited zone of the needle cylinder.
Figure 12A:
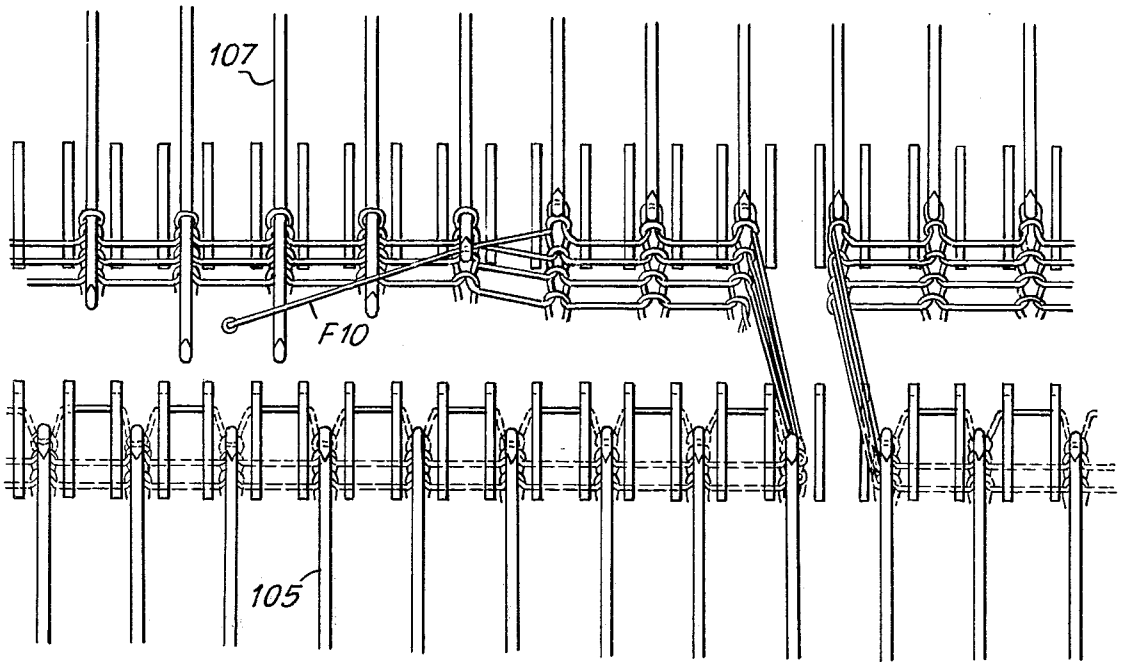
Figure 12C:
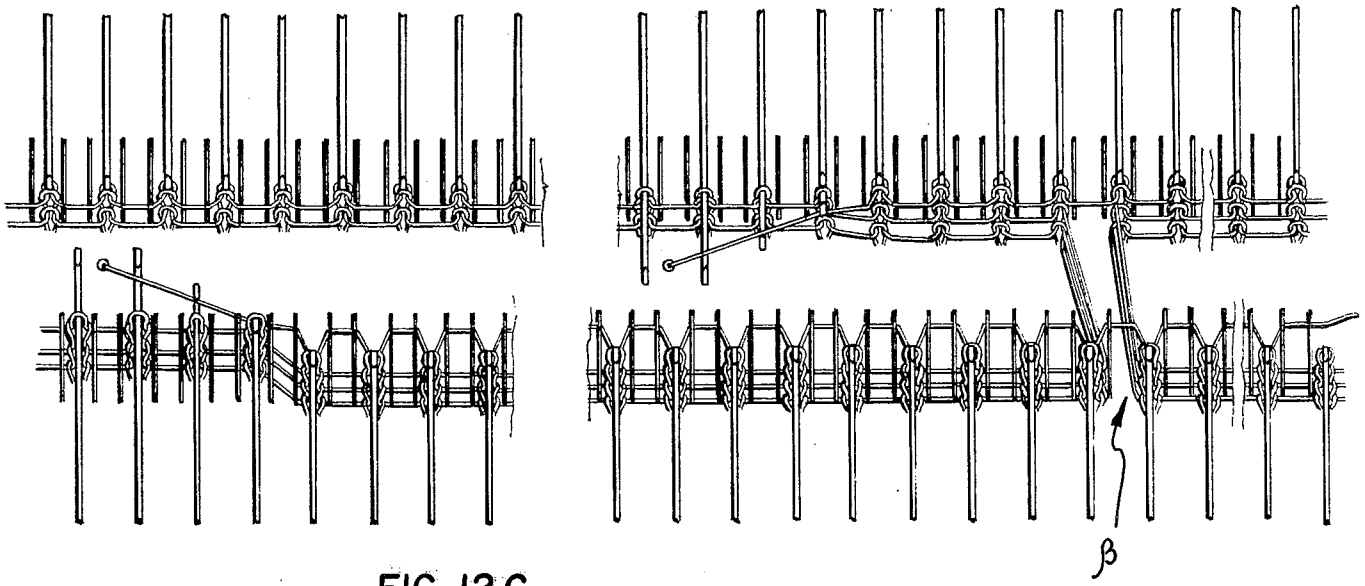
FIG. 12C is a view similar to FIG. 12A illustrating the stitch formation in a point on the final course.
Figure 13:
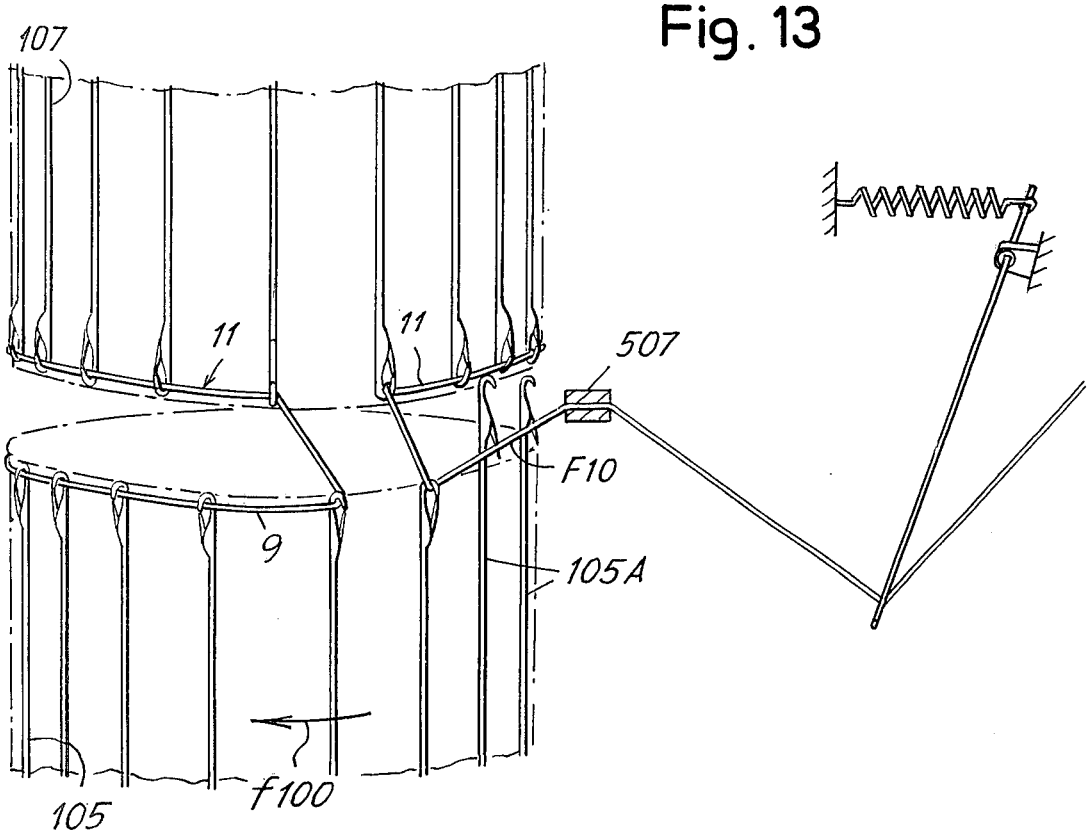
FIGS. 13 through 18 are schematic perspective views illustrating some of the working steps utilizing oscillatory motion of the two needle cylinders and the initial working steps utilizing continuous motion of the needle cylinders.

During the above described steps involving reciprocal motion in the direction of the arrows f100 and f102, the two fabrics 9 and 11 are formed, as shown in perspective in FIGS. 12A and 12B. In FIGS. 13 through 18, as it is impossible to represent the view of the interlacings from the outside of the needle cylinder, instead of the interlacing of the stitches, there is symbolically shown a simple yarn stretched and engaged by the respective needles. In FIG. 13, the beginning of the knitting is illustrated as performed with the needles 105 of the lower cylinder, and as seen from the outside of the cylinder. By virtue of rotation of the cylinder in the direction of arrow f100, needles 105 are raised by cams 503 and 501 and take yarn F10 from yarn guide 507. In FIG. 13, the needles instantaneously raised by cams 503 and 501 are indicated at 105A.

Figure 14:
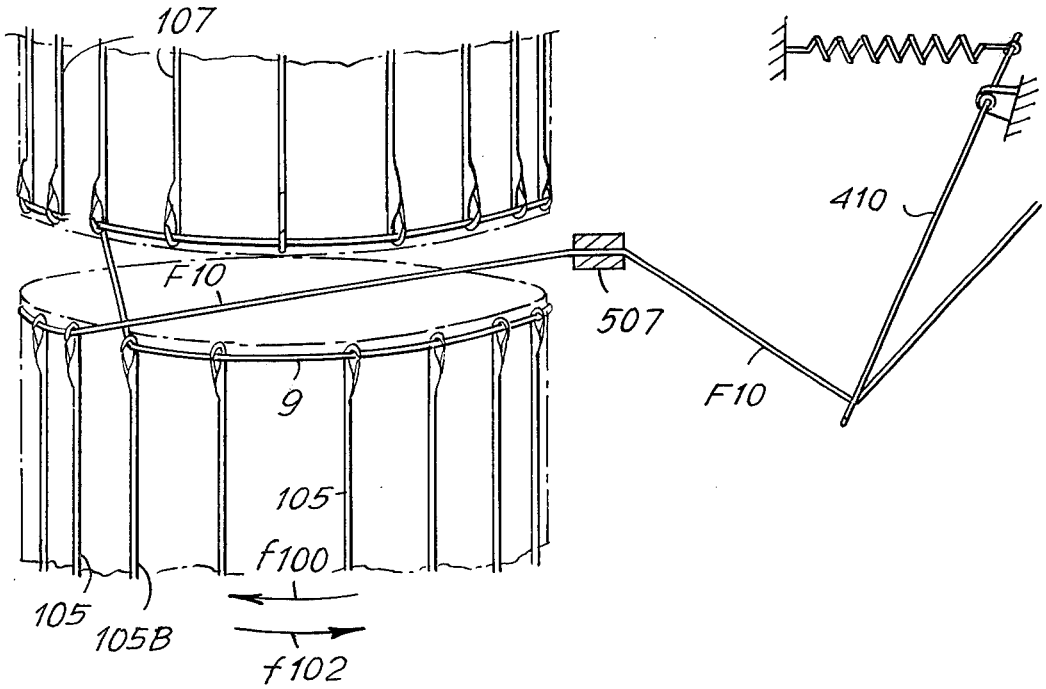

FIG. 14 illustrates a working step in which the motion in the direction of arrow f100 is ceasing and the motion in the direction of the arrow f102 is beginning, this working step corresponding to the working step illustrated in FIG. 23. The last needle 105 of the lower cylinder illustrated at 105B, has been raised and has taken the yarn F10. When movement in the direction of arrow f102 commences, yarn F10 is recovered by a conventional means, such as a small rod 410, shown in FIGS. 14 and 15, which is under the bias of a spring, the recovery of the yarn occurring when no needle is being moved and continuing until, as shown in FIG. 15, the "raising" downwardly of the initial needles 107A has begun by the action of cams 603 and 601, shown in FIG. 24. Thus, fabric 11 is formed with needles 107 during the motion in the direction of arrows f102, as shown in FIGS. 24 and 16. The operation is cyclically repeated in periodic reversals of the direction of rotation of the cylinders.

Figure 26:
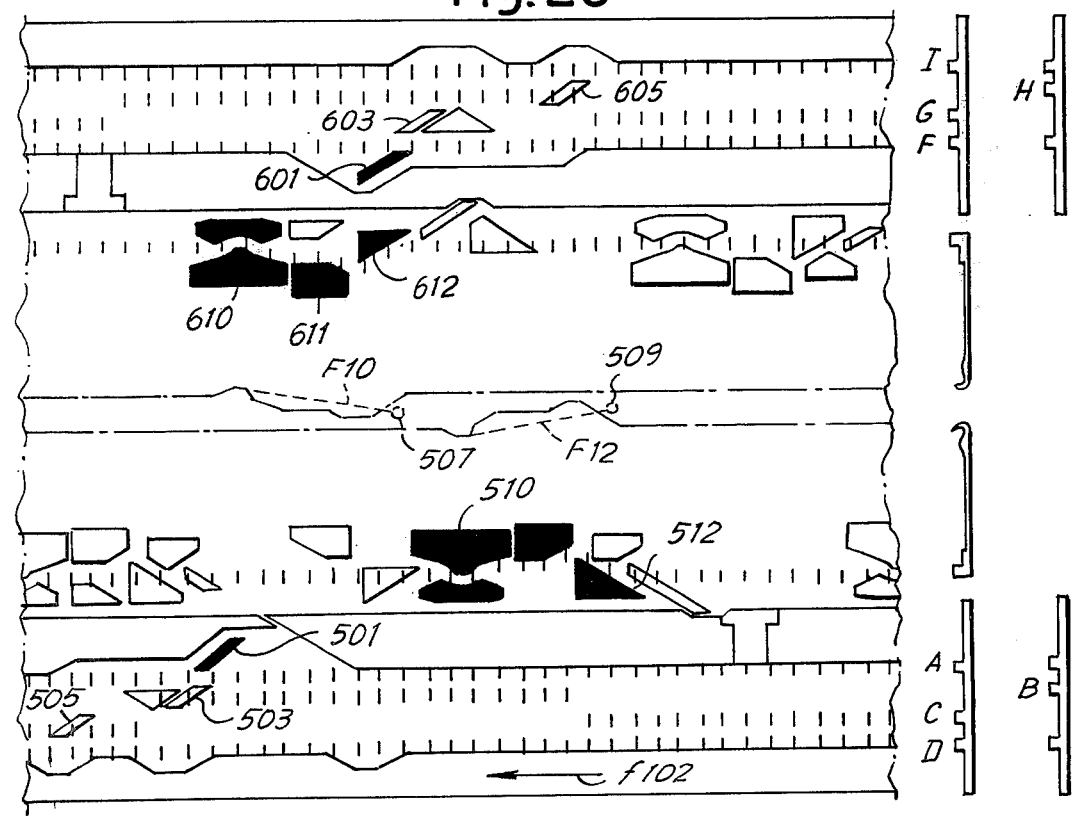

When it is necessary to start the continuous rotation, at the end of the working step shown in FIG. 25 and in the direction of the arrow f102, or even before the end of the working step shown in FIG. 25, in addition to the yarn guide 507 a yarn guide 509 is moved into operation. Yarn guide 509 is positioned substantially equidistant between the upper and lower cylinders and in such a position as to feed a yarn F12 to the needles operated by the stitch forming cam 510. This yarn F12 initially is taken in the usual manner for the beginnig of a new yarn feed. In fact, the usual needle raising cams 512 and 612, shown in FIGS. 25 and 26, are inserted to act on the butts of needles 105 and 107. In a known manner, cams 512 and 612 are inserted in two steps, as the needle butts are at two different heights along two arcs, complementary with each other, of the needle cylinder circumference. At this point, the yarn guide in position 507 feeds yarn F10 to needle 107 which forms stitches by actuation by cams 612 and 610 to form the tube or leg 19, while yarn guide 509 feeds yarns F12 to needles 105 that form the stitches by actuation by cams 512 and 510 to create the tube or leg 17. Yarn 512 begins to be taken by the first needle with a long butt that is raised by cam 512, and forms the stitch when actuated by cam 510. The upper and lower cylinders continue to rotate in the direction f102 to form the tubular portions 17 and 19 by simultaneous and independent knitting operations.

Figure 17:
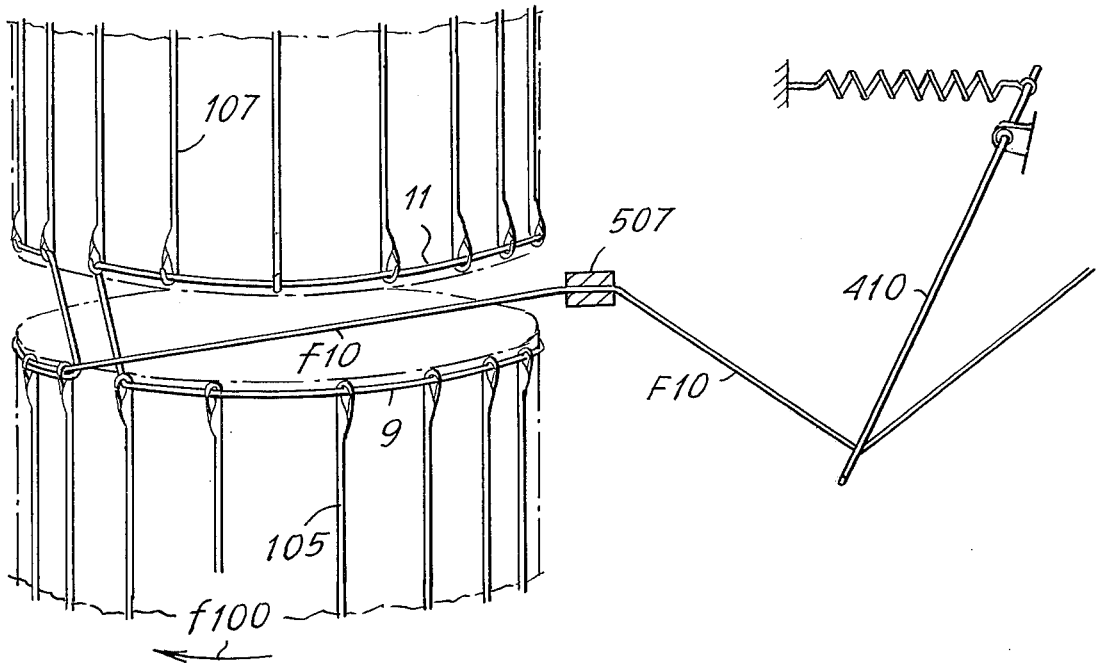
Figure 18:
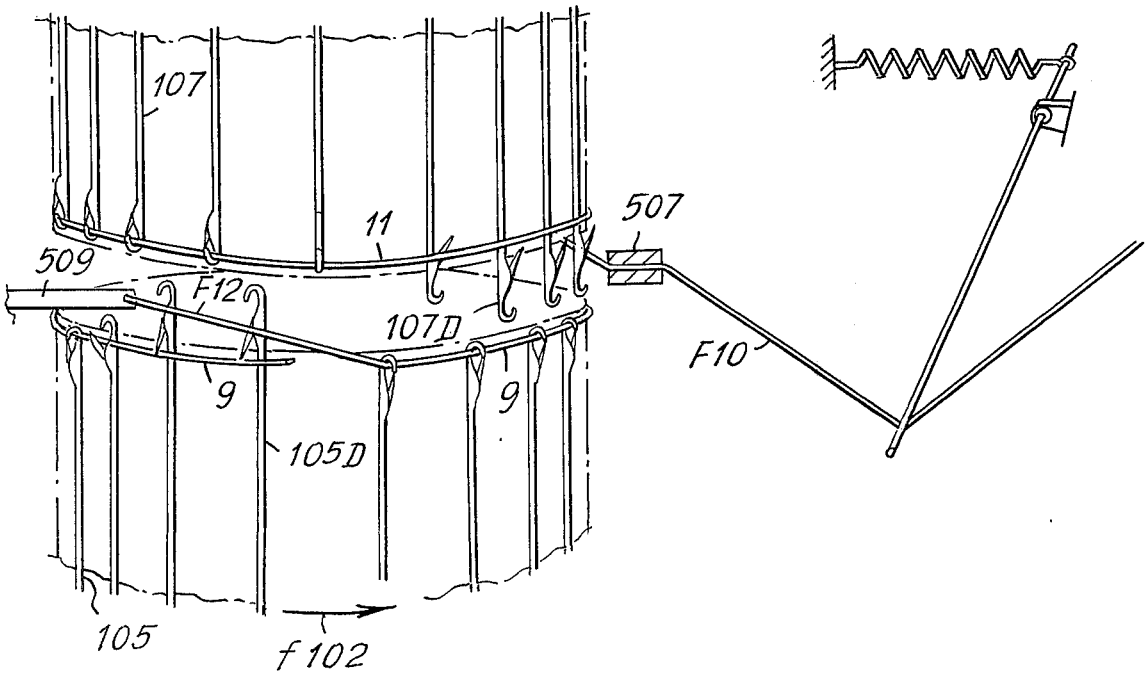
Figure 17A:
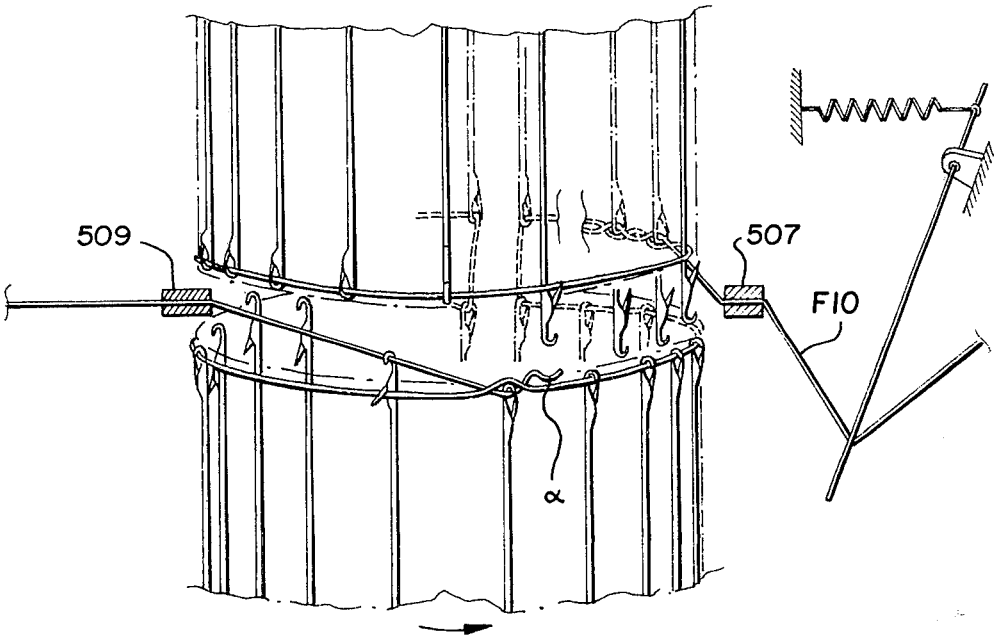
FIG. 17A illustrating a stage between those of FIGS. 17 and 18.

FIG. 17 illustrates the working step at the end of the oscillatory motion and the beginning of the continuous motion in the direction of arrow f102. FIG. 18 illustrates the condition in which, at the beginning of the continuous motion, the lower fabric 9 is beginning to be formed with the yarn F12 coming from yarn guide 509 which has just been inserted, and being knitted by needles 105 raised, as indicated at 105D in FIG. 18, by cam 512, while yarn F10 continues to be knitted by the upper needles 107 now "raised" by cam 612 as indicated at 107D.

Figure 27:
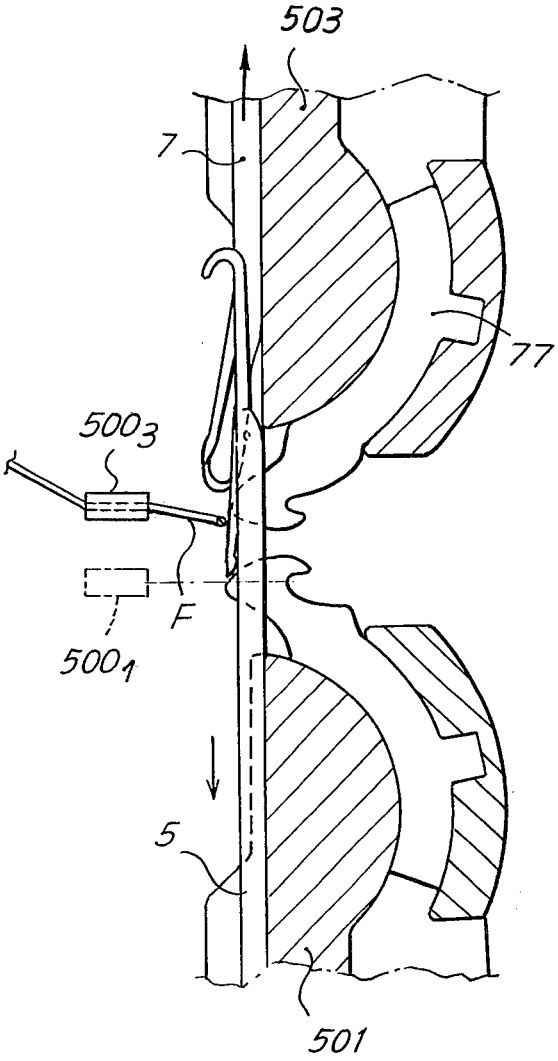
FIG. 27 is a view similar to FIG. 8 but illustrating the shifting of the yarn guide between the two needle cylinders.
Figure 28:
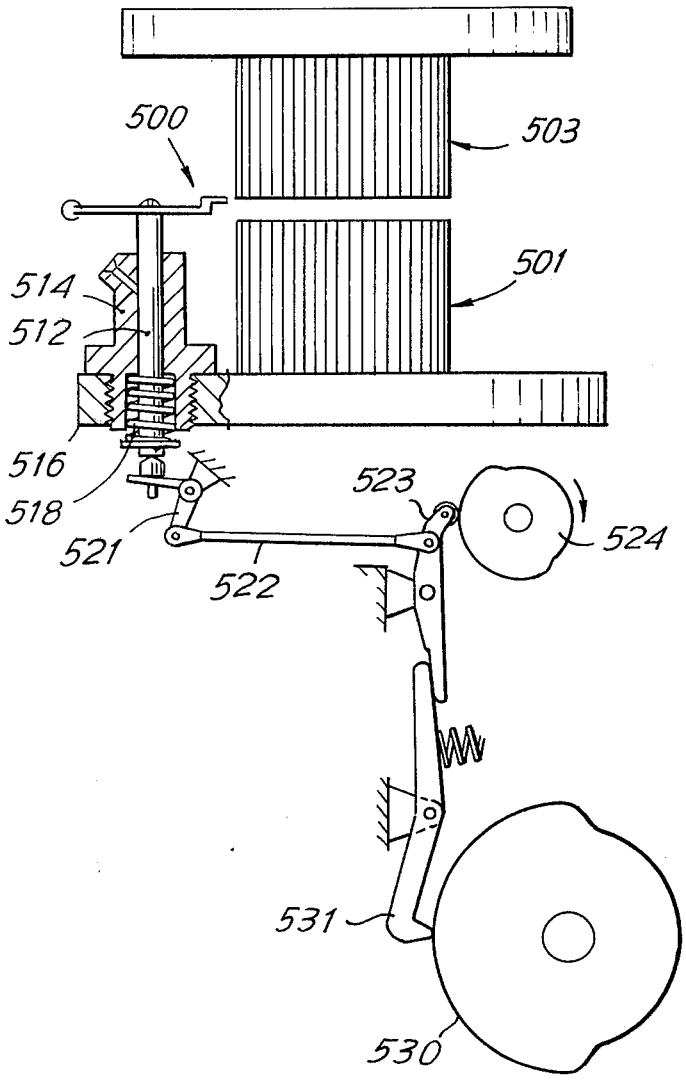
FIG. 28 is an elevation view, partly in section, illustrating mechanism for cyclically shifting the yarn guide.

In the working steps shown in FIGS. 13 through 26, the yarn guide is kept stationary in a position intermediate the upper and lower cylinders to feed the yarn to the upper and lower needles in alternation. It is also possible to use a vertically displaceable yarn guide, as shown in FIGS. 27 and 28. FIG. 27 is a view similar to FIG. 8 but showing the yarn guide as vertically displaceable, where FIG. 28 illustrates the arrangement for effecting vertical movement of a yarn guide 500 to feed yarn alternately to cylinders 501 and 503 at any reversal of the motion thereof.

Referring to FIG. 28, yarn guide 500 is supported on a small column 512 which is slidable in a guide sleeve 514 mounted on the stationary structure 516 of the knitting machine. A spring 518 biases column 512 downwardly, and thus yarn guide 500 is biased downwardly to a feed position $500_1$ of the needles of cylinder 501, which is identical with the cylinder 1 of FIG. 8. The raised position $500_3$ of yarn guide 500, to feed the needles of cylinder 503, which is the same as the cylinder 3 of FIG. 8, can be obtained by means of a linkage 521, 522 actuated by a cam follower 523 engaged with a cam 524. Cam 524 completes one rotation for each two rotations of the cylinder, and its steps are presented to cam follower 523 when the reversal of the cylinder takes place every 360°. In this manner, there is obtained a cyclical raising and lowering of yarn guide 500.

To make this control inoperative, it is sufficient to provide a cam on the program drum 530 of the knitting machine, which program drum makes one complete rotation for every article, such as a stocking. A tappet or cam follower 531 engages the cam track on drum 530 and puts the control out of action by disengaging cam follower 523 from cam 524 with the yarn guide being moved into the position $500_3$, or vice versa into the position $500_1$.

It should be noted what, in FIG. 8, the yarn F, whether it is single or double, is illustrated as greatly displaced. In practice, the position of yarn F and of yarn guide 500 in the arrangement is as shown in FIG. 27 and, in practice, the yarn guide, if it is movable, can be displaced into the two positions $500_1$ and $500_3$ substantially corresponding to the respective planes P5 and P7 of the sinkers as indicated in FIG. 8.

The tights or pantyhose produced as particularly described are similar to tights produced from two separate tubular portions longitudinally cut and then manually sewn together, these latter tights being relatively expensive to produce, being liable to ladder and having other defects.

While specific embodiments of the invention have been shown and described in detail to illustrate the application of the principles of the invention, it will be understood that the invention may be embodied otherwise without departing from such principles.

What is claimed is:

1. A method for forming a pantyhose having two tubular leg portions and a pant portion using a circular knitting machine having two groups of needles. comprising forming the pant portion by conjoint oscillation of the two groups of needles to produce courses of stitches extending over substantially 360°; passing a yarn from one group to the other group of needles at the end of each oscillation so as to form inner and outer longitudinally split tubular layers of fabric which are joined together along their longitudinal edge portions; and forming the leg portions by continuous conjoint rotation of the two groups of needles with an independent feed to each group of needles so as to produce one leg portion within the other leg portion, the said other leg portion having a plain stitch and the said one leg portion having a purl stitch while the leg portions are disposed one within the other during formation thereof.

2. A method for forming a pantyhose having two tubular leg portions and a pant portion using a circular knitting machine having two groups of needles, comprising the steps of forming the pant portion by conjoint oscillation of the two groups of needles so as to produce courses of stitches extending over substantially 360°; transferring yarn from one group of needles to the other group of needles at the end of each oscillation, so as to form inner and outer longitudinally split layers of fabric which are joined together along their longitudinal edge portions; and then forming the leg portions by continous conjoint rotation of the two groups of needles with an independent feed to each group of needles so as to produce one leg portion within the other leg portion; the fabric of the outer leg portion having a plain stitch and the fabric of the inner leg portion having a purl stitch; the inner leg portion subsequently being withdrawn from the outer leg portion.

3. A method as claimed in claim 1, wherein the initial portion of the pant portion is formed by using a resilient yarn whereby to produce a resilient waist band.

4. A method as claimed in claim 1, wherein the pant portion is produced using two combined yarns supplied by two yarn guides, and wherein each leg portion is produced using a respective one of the two yarns.

5. A circular knitting machine, for forming a pantyhose having two tubular leg portions and a pant portion, comprising means defining two coaxial grooved needle beds; respective groups of needles each associated with only one respective bed; means operable to operate the needles of each group independently of the needles of the other group and without interference with the needles of the other group; means operable selectively to oscillate the two beds synchronously through substantially 360° and to continuously rotate the two beds; means operable to feed a common yarn alternately to each group of needles at each reversal during the oscillatory movement of the beds; means operable to feed respective yarns independently to each group during continuous rotation of the beds; and means actuating the needles of the two groups alternately during the oscillatory movement and actuating the needles of the two groups simultaneously, but without interference with each other, during the continuous rotation of the two groups.

6. A machine as claimed in claim 5, wherein the needles of one group are offset with respect to the needles of the other group.

7. A machine as claimed in claim 6, wherein the groups of needles comprise coaxial grooved cylinders and conventional needles.

8. A machine as claimed in claim 5, further comprising a respective sinker flanking each said needle whereby two sinkers are located between adjacent needles in each said group.

* * * * *